United States Patent [19]

Wilson

[11] 4,365,448

[45] Dec. 28, 1982

[54] SANDING WHEEL

[76] Inventor: Byron Wilson, 3650 Green Acre Rd., Oakland, Calif. 94619

[21] Appl. No.: 168,747

[22] Filed: Jul. 14, 1980

[51] Int. Cl.[3] ..... B24B 9/02

[52] U.S. Cl. ..... 51/334; 51/394; 51/401

[58] Field of Search ..... 51/334, 335, 336, 337, 51/394, 401; 15/230, 230.16

[56] References Cited

U.S. PATENT DOCUMENTS 1,118,153 11/1914 Sanborn ..... 51/336

2,370,491 2/1945 Rice ..... 51/334

2,763,104 9/1956 Lindenberg ..... 51/337

3,486,276 12/1969 Block ..... 51/335

*Primary Examiner*—Harold D. Whitehead

*Attorney, Agent, or Firm*—Alvin E. Hendricson

[57] ABSTRACT

An improved abrasive structure and holder for sanding or the like has a continuous strip of sandpaper or emery cloth folded and secured together to form a circle with radial flaps or fingers extending therefrom and may have a circular stiffener all for cooperating with an annularly grooved disc with radial slots and a cover plate to form a rotary sanding wheel.

1 Claim, 5 Drawing Figures

SANDING WHEEL

BACKGROUND OF THE INVENTION

Rotary sanders and grinders have been formed in a wide variety of configurations which are adapted to be rotated as by an electric motor to move an abrasive surface relative to a work piece. The abrasive may be mounted upon a flat rotary surface or upon an extension from an annular surface.

One type of rotary sander having flexible radial abrasive strips and termed a surfacing apparatus is shown in an early U.S. Pat. No. 2,174,385 and later improvements to and variations thereof are shown, for example, in U.S. Pat. Nos. 2,257,061, 2,871,632, 3,533,198, 3,685,217 and 3,800,481. These types of sanders, sometimes called floppy sanders are widely marked for a variety of purposes and are known to be marketed under names such as "Grind-O-Flex", flap wheels and finger strip sanders.

The type of sander noted above may be formed with replaceable abrasive strips or with fixed strips; however, the cost of the latter is substantial to the user and the effort of replacing the strips of the former is formidable.

The present invention provides an improved rotary sander with radially extending abrasive having a simple readily replaceable abrasive.

SUMMARY OF INVENTION

The rotary sander of the present invention employs an annularly grooved disc or drum with radial slots extending outward from the groove and an end plate or cap for retaining a particularly formed and configured abrasive strip. The abrasive hereof is provided upon paper, plastic or cloth in elongated strip form which is folded and joined together to form a circle with radial flaps or fingers thereabout having abrasive on both flat sides thereof. Joinder of portions of the strip to attain the noted configuration is preferably accomplished by an adhesive and the circle may be reinforced by a thin ring of cardboard or the like also adhered to the plane side of the adhesive strip. It is also possible to form the abrasive element of more than one strip provided in end-to-end relationship.

The grooved disc of the present invention is dimensioned to accommodate insertion of the abrasive element in the annular groove thereof with the flexible flats or fingers extending radially outward of the disc through the radial slots. The end plate or cap is removably affixed to the disc over the groove and slots as by a cap nut threaded onto an end of a central shaft of the disc adapted to be inserted in a rotary driven chuck of a stationary or portable tool. Commonly such tools only rotate in one direction and it will be appreciated that the abrasive element hereof may be reversed in the disc or drum to thereby double the wear available with each element.

DESCRIPTION OF DRAWINGS

The present invention is illustrated as to particular preferred embodiments in the accompanying drawings, wherein.

DESCRIPTION OF PREFERRED EMBODIMENT

Figure 1:
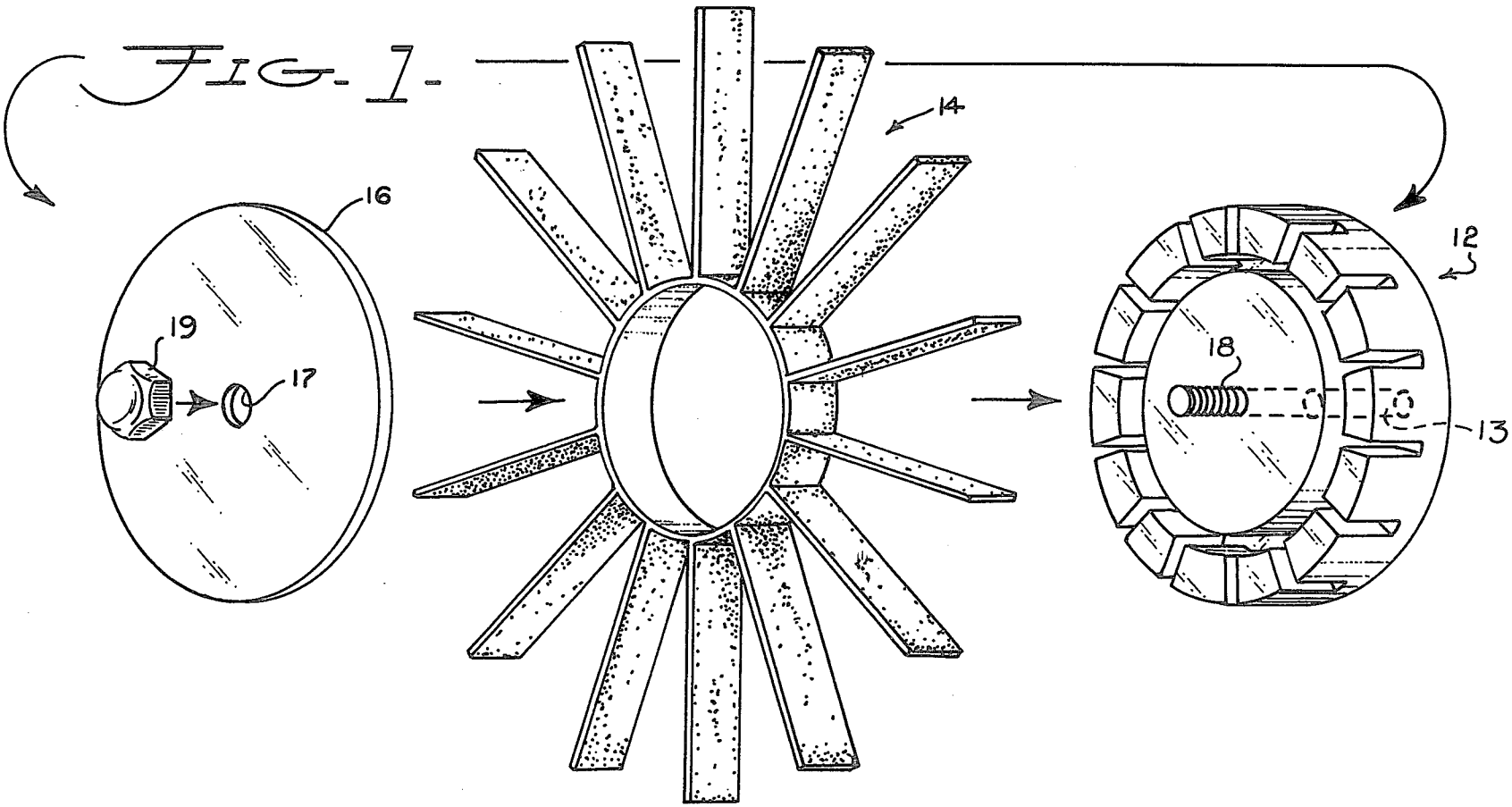
FIG. 1 is an exploded perspective view of a preferred embodiment of a rotary sander in accordance with the present invention.

A complete rotary sander in accordance with the present invention is comprised of four elements illustrated in FIG. 1 and referring thereto there will be seen to be provided a grooved disc 12 having a shaft 13 extending axially therethrough in fixed relation thereto. An abrasive element 14 is provided to removably fit within the grooves of the disc 12. A cover plate 16 fits upon the grooved end of the disc 12 and has a central apperture 17 therethrough for fitting over a short threaded end 18 on the shaft 13. A cap nut 19 is adapted to be threaded on the shaft end 18 to secure the cover plate 16 on the disc and thus retain the abrasive elements in the disc.

Figure 3:
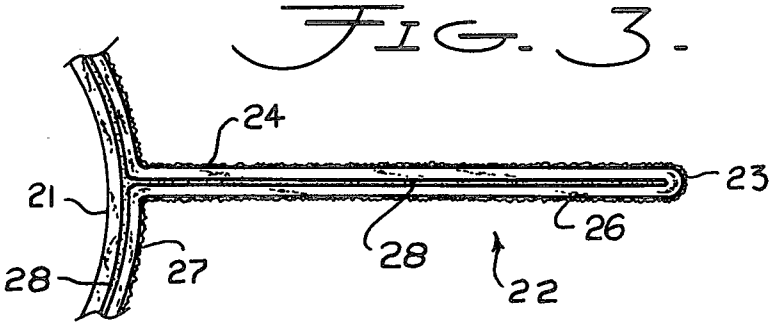
FIG. 3 is a partial enlarged view of the abrasive element of FIG. 2.
Figure 5:
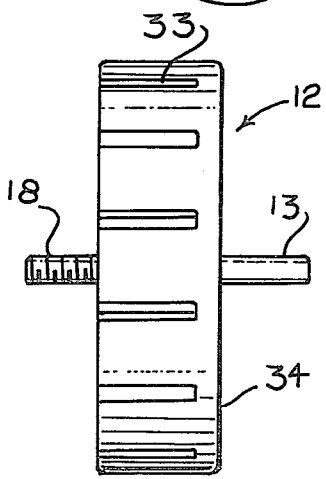
FIG. 5 is a side elevational view of the disc of FIG. 4.
Figure 4:
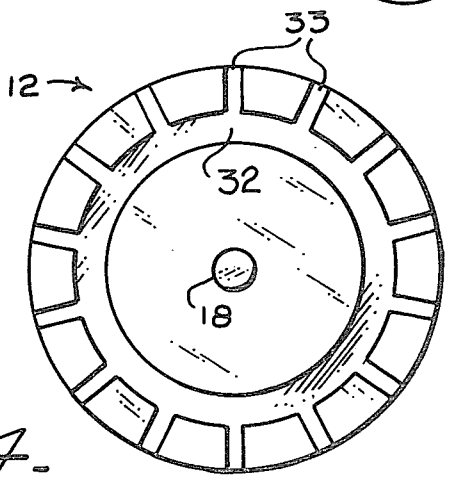
FIG. 4 is an end elevational view of a grooved disc or drum in accordance with the present invention.
Figure 2:
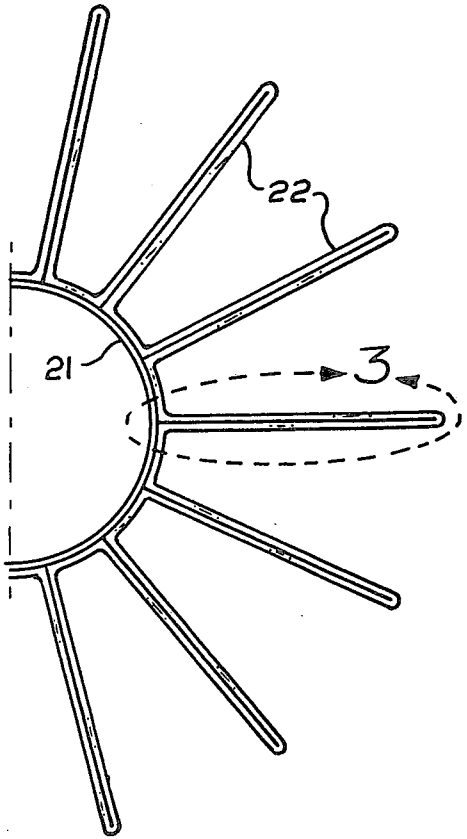
FIG. 2 is an end elevational view of an abrasive element in accordance with the present invention.

Considering now the abrasive element of the present invention and referring particularly to FIGS. 2 and 3 of the drawings, it will be seen that same generally is provided as a circular configuration with radial arms or the like extending therefrom. As illustrated, there is provided a reinforcing ring 21 and upon the outer surface thereof there is affixed an elongated flexible strip 22 which may be formed of paper, cloth or possibly some type of plastic substrate 23 having on the outer surface thereof an abrasive material 24. This strip 22 may be cut or otherwise divided from a sheet of conventional sandpaper, emery cloth or other similar material and the abrasive material on the external surface thereof may be adhered in any conventional manner. The strip 22 extends a short distance peripherally of the ring 21 on the exterior surface thereof between successive outward folded portions or flaps 26, particularly as illustrated in FIG. 3 of the drawings. The short peripheral sections 27 of the strip are affixed to the ring 21 as by an adhesive 28 and the contacting surfaces of the folded flap 26 are also preferrably adhered together by the same adhesive. Successive folded flaps 26 separated by peripheral portions 27 are formed entirely about the ring 21 to thus define an annular element having equally spaced radial arms or flaps extending therefrom about the entire circumference thereof. It will be appreciated that the flaps or arms are flexible and the overall abrasive element 14 may be formed without the reinforcing ring 21 which is provided primarily for the purpose of facilitating insertion of the abrasive element in the grooved disc 12 described below.

The disc or drum 12 of the present invention is formed as a short cylinder of rigid material such as a plastic or light metal and is provided upon the front face 31 thereof with an annular groove 32 centered on the axis of the shaft end 18 and having a diameter equal to the diameter of the ring 21 of the abrasive element 14. The annular groove 32 extends into the front face 31 of the disc a depth substantially equal to the width of the abrasive strip 22 and the ring 21. There are also provided in the front face 31 of the disc 12 a plurality of radial slots 33 extending from the annular groove 22 radially outward to the other periphery of the disc 12. The radial slots 33 are provided with the same depth as the annular groove 32 and are equally spaced about the disc in position to accommodate the radial arms or flaps 26 of the abrasive element 14. The width of the radial slots 33 are made substantially or slightly greater than the width of the radial arms or flaps 22 of the abrasive element and the width of the annular groove 32 is made euqal or slightly greater than the total radial width of the annular rim 21 and strip sections 27 thereon. Under the circumstances wherein the abrasive element is formed without the reinforcing ring 21 the width of the annular groove 32 may be reduced to substantially the thickness of the abrasive strip 22.

The rotary sander of the present invention may be readily assembled merely by inserting abrasive element 14 in the annular groove 32 and radial slots 33 of the disc 12. With or without the reinforcing ring 21 this abrasive element may be readily inserted in the disc and it will be appreciated that the solid back surface 34 of the disc prevents the abrasive element from sliding too far to or even through the disc. The cover plate 16 is then inserted on the threaded shaft end 18 to lie against the front face 31 of the disc and the cap nut 19 is threaded onto the shaft end to lock the cover plate in position holding the abrasive element in the disc. The flexible flaps or arms of the abrasive strip 22 extends radially outward of the disc 12 so as to be available for sanding, grinding, polishing, brushing or buffing of a work piece when the sander is rotated to engage the flaps or the like with the work piece. The flexible nature of the flaps or arms 26 provide advantageous sanding surface, for example, wherein even curved surfaces may be readily operated upon. It will, of course, be appreciated that the threads in the shaft end 18 are properly oriented so that rotation of the sander will not loosen the nut 19 on the shaft end 18.

It will be appreciated that the radial flaps or arms of the present invention have an abrasive material on both sides of same. Inasmuch as most rotary sanders, drills or the like upon which the present invention may be employed are adapted to rotate in only one direction or are at least primarily employed by rotating in only a single direction, it is only necessary with the present invention to reverse the orientation of the abrasive element in the disc hereof in order to present a fresh sanding or abrasive surface when the original surface becomes worn. This is readily accomplished by removing the nut 19 and cover plate 16, withdrawing the abrasive element from the disc 12 and turning the abrasive element around and reinserting it in the disc. Reattachment of the cover plate by the nut 19 will then lock the abrasive element in position to be employed with a fresh sanding or abrading surface.

The grooved and slotted disc 12 with integral shaft and the cover plate and locking nut are substantially permanent, reusable units while the abrasive element 14 is replaceable. The abrasive element is readily and inexpensively formed by looping a continuous strip of sandpaper, emery cloth or the like into the form illustrated and described and gluing facing surfaces of the substrate 23 together to form the flaps or arms of the abrasive element. Under the circumstances where the reinforcing ring or core 21 is employed, the abrasive strip may be formed thereabout and glued thereto, as described above. It is also possible to otherwise affix the abrasive strip to the ring or core 21 as by mechanical means and it is also possible, in the absence of the ring 21, the mechanically affix the two sides of the flap 26 together, at least at the base thereof to alternatively form the abrasive element. It has, however, been found that the use of any of a variety of commercial adhesives is preferrable in manufacture of the abrasive unit.

In summary, it is noted that there has been described above a single rotary sander of the type having flexible arms or flaps extending radially from the periphery of a rotary unit. Although the present invention has been described with respect to a particular preferred embodiment thereof, it will be appreciated by those skilled in the art that numerous modifications and variations are possible within the scope of the present invention and thus it is not intended to limit the invention to the precise details of illustration or terms of description.

What is claimed is:

1. An abrasive element for a rotary sander comprising an elongated strip of flexible substrate having an abrasive material affixed to an outer surface, said strip being configured in a continuous endless loop with outwardly folded flaps each separated by a short section and said substrate contacting at each fold, means attaching each side of said folded flaps together at least in the base of each fold to provide a circular portion with radial flaps presenting an abrasive outer surface on each side of each flexible flap, and a substantially rigid ring disposed interiorly of said strip and contacting each of said short sections between said folded flaps with means securing said strip to said ring at said short sections.

* * * * *